US006971547B2

(12) United States Patent
Englert et al.

(10) Patent No.: US 6,971,547 B2
(45) Date of Patent: Dec. 6, 2005

(54) DISPENSING PACKAGE WITH LOCKABLE CLOSURE

(75) Inventors: Christopher Englert, Bel Air, MD (US); Kirstin Huesmann, Newark, DE (US); Donald Kerr, Newark, DE (US)

(73) Assignee: Berry Plastics Corporation, Evansville, IN (US)

( * ) Notice: Subject to any disclaimer, the term of this patent is extended or adjusted under 35 U.S.C. 154(b) by 0 days.

(21) Appl. No.: 10/358,168

(22) Filed: Feb. 5, 2003

(65) Prior Publication Data

US 2004/0149787 A1 Aug. 5, 2004

(51) Int. Cl.[7] ..... G01F 11/00
(52) U.S. Cl. ..... 222/1; 222/153.14; 222/556
(58) Field of Search ..... 222/153.14, 546, 222/556, 1

(56) References Cited

U.S. PATENT DOCUMENTS 4,756,451 A * 7/1988 Wilson ..... 222/534
4,838,460 A * 6/1989 Moore et al. ..... 222/153.13
5,314,093 A * 5/1994 Gross et al. ..... 222/153.14
5,379,926 A * 1/1995 Mueller et al. ..... 222/507
5,622,284 A * 4/1997 Sawicki ..... 222/153.14
5,649,645 A * 7/1997 Demarest et al. ..... 222/153.07
5,709,318 A * 1/1998 Oder ..... 222/153.06
6,478,194 B2 * 11/2002 Haglund et al. ..... 222/153.14

* cited by examiner

*Primary Examiner*—Joseph A. Kaufman
(74) *Attorney, Agent, or Firm*—Barnes & Thornburg LLP

(57) ABSTRACT

A disc top dispensing closure which includes a body having an opening and an actuator having a channel mounted to the closure body. The actuator is pivotable about a pivot axis between an open position, wherein the channel and the opening of the body form a continuous fluid path, and a closed position, wherein the channel and the opening of the body do not form a continuous fluid path. The actuator is also rotatable between a locked position, wherein the actuator is not movable between the open and the closed position, and an unlocked position, wherein the actuator is movable between the open and the closed position. The pivot axis is parallel to but offset from a plane in which the longitudinal axis of the closure exists.

32 Claims, 4 Drawing Sheets

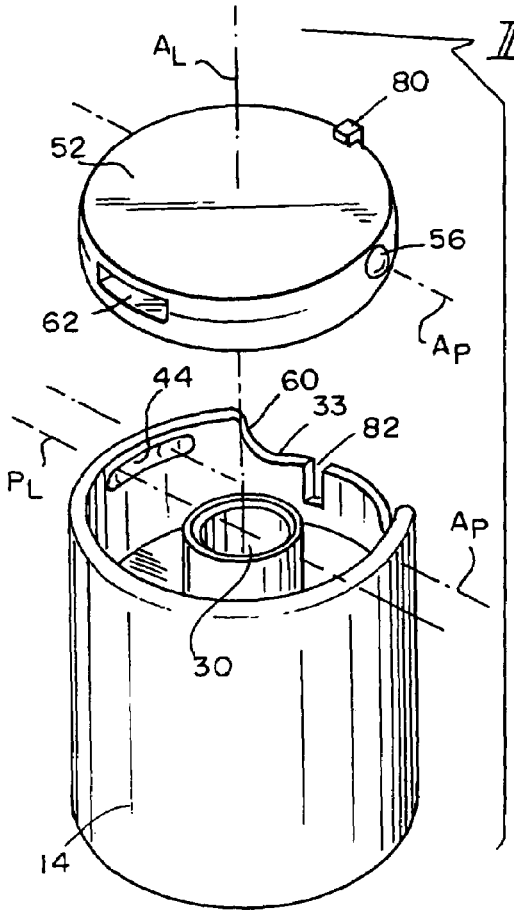
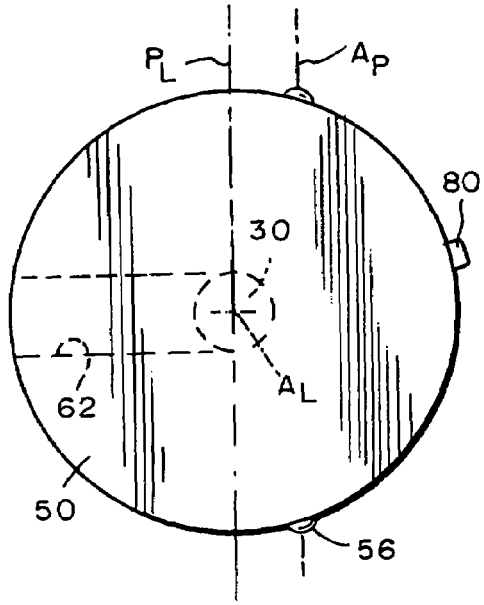
FIG. 8
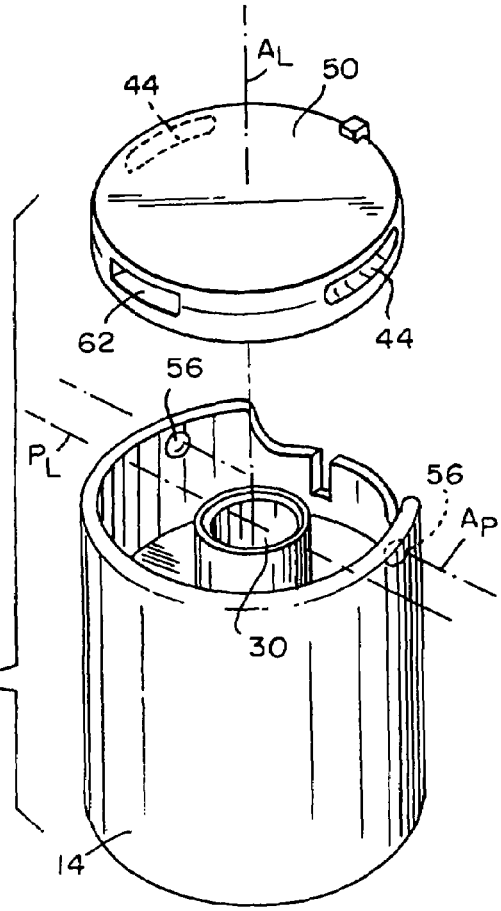
FIG. 9

DISPENSING PACKAGE WITH LOCKABLE CLOSURE

BACKGROUND

The present invention is directed to packages for dispensing fluid products, and more particularly to a package having a dispensing closure which is lockable so as to prevent the accidental opening of the closure.

Fluid dispensing closures typically include a base which is secured to the neck of a container, and an actuator disc pivotally mounted on the base. The disc is capable of being pivoted between a closed position that closes a dispensing opening in the closure base, and an open position that allows for dispensing a fluid product from the container.

A disadvantage with the above-described closures is that a relatively small amount of force is needed to pivot the disc from the closed position to the open position and thus, these type of closures can readily accidentally open and spill the contents of the container either during shipping to the consumer or when packed for travel by the consumer. The latter problem is particularly annoying to consumers as they discover that their packed containers have opened and spilled their contents within their travel bags.

There are many types of lockable dispensing closures available. Typically, however, these closures only address the problem of preventing leakage during shipping to the consumer. Generally, with these locking closures, the locking feature is either removed or rendered ineffective after the first use by the consumer, or it requires more than two pieces.

Accordingly, there is a need for a dispensing closure which can prevent leakage during the shipping to the consumer and that can be repeatedly used when the container is packed for travel by the consumer.

SUMMARY

In accordance with a preferred embodiment of the present invention, a closure is provided that includes a body having an opening and an actuator mounted to the body about a longitudinal axis of the body. The actuator has a channel, a rear profile and is pivotable between an open position and a closed position. Further, the actuator is rotatable between a locked position and an unlocked position. Also, the actuator is pivotable about a pivot axis located between the longitudinal axis and the rear profile.

In accordance with an aspect of the present invention, the body includes a pair of races extending circumferentially along an interior portion of the body. The actuator includes a pair of protrusions each being engagable with a respective race and movable along the races so as to facilitate rotation of the actuator between the locked position and the unlocked position.

In accordance with another preferred embodiment of the invention, a dispensing package is provided with a container defining a chamber and having an orifice in fluid communication with the chamber and a closure mounted on the container. The closure includes a body having an opening and an actuator mounted to the body about a longitudinal axis of the body. The actuator has a channel, a rear profile and is pivotable between an open position and a closed position and the actuator is rotatable between a locked position and an unlocked position. Further, the actuator is pivotable about a pivot axis located between the longitudinal axis and the rear profile.

These and other aspects and features of the invention will become apparent from the following detailed description of the invention.

BRIEF DESCRIPTION OF THE DRAWINGS

FIG. 7 is an exploded perspective view of the locking closure of FIG. 1.

FIG. 8 is a top view of the actuator of the locking closure of FIG. 1.

FIG. 9 is an exploded perspective view of the locking device closure, similar to FIG. 7, but with the race 44 on the actuator 50 and the protrusion 56 on the body 14.

DETAILED DESCRIPTION OF PREFERRED EMBODIMENTS

Figure 1:
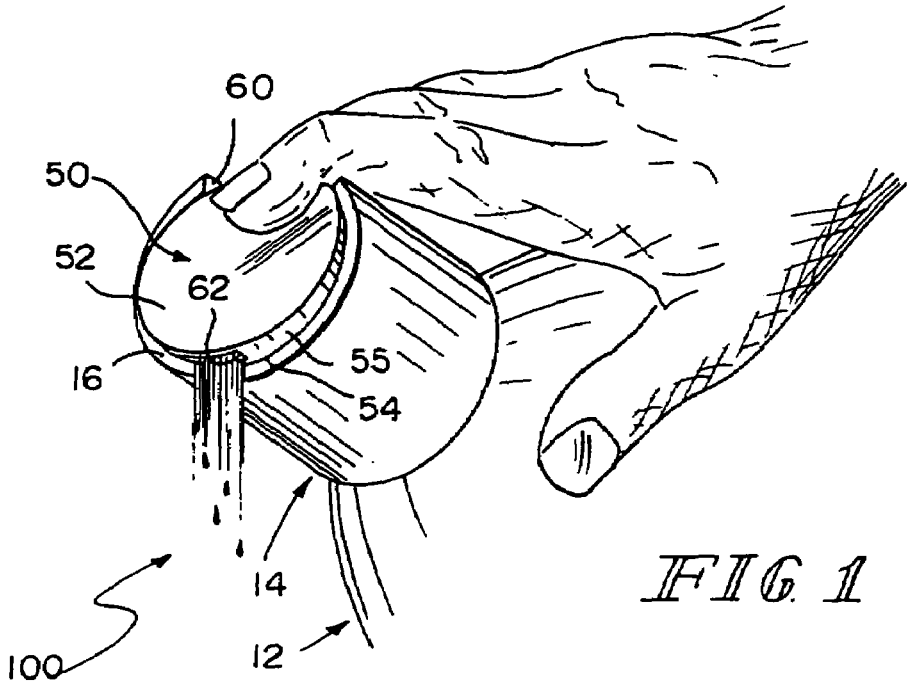
FIG. 1 is a perspective view of a dispensing package in use according to a preferred embodiment of the present invention.
Figure 2:
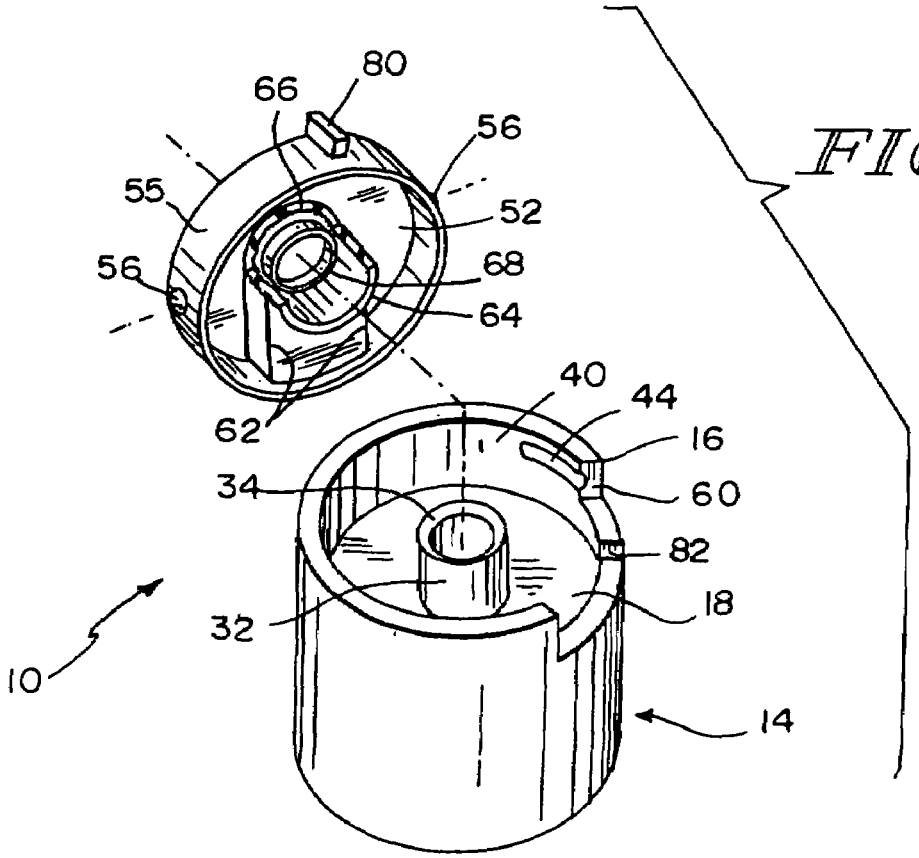
FIG. 2 is an exploded perspective view of the locking closure of the dispensing package of FIG. 1.
Figure 3:
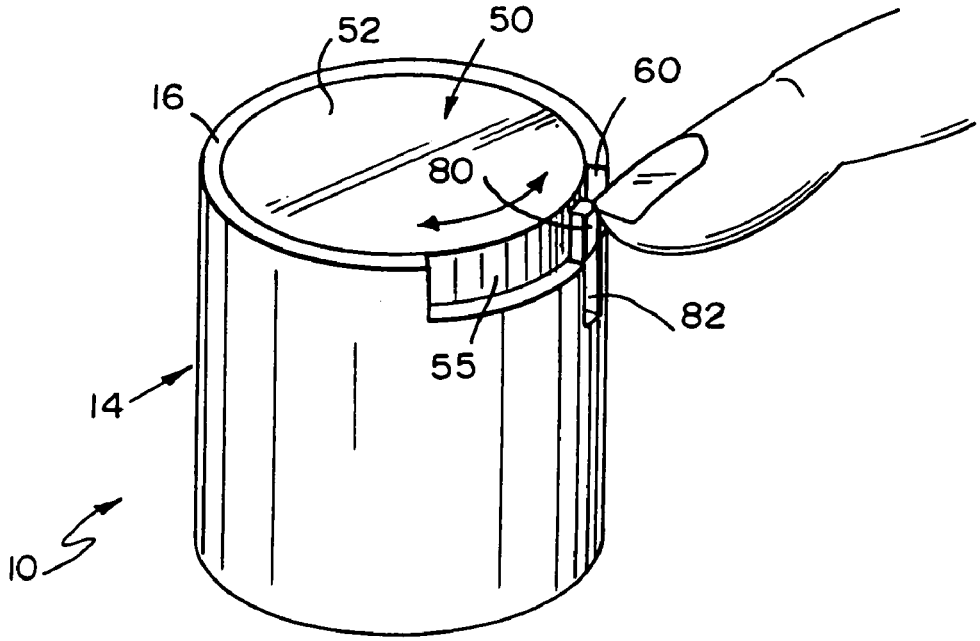
FIG. 3 is an enlarged perspective view of the locking closure of FIG. 1.
Figure 4:
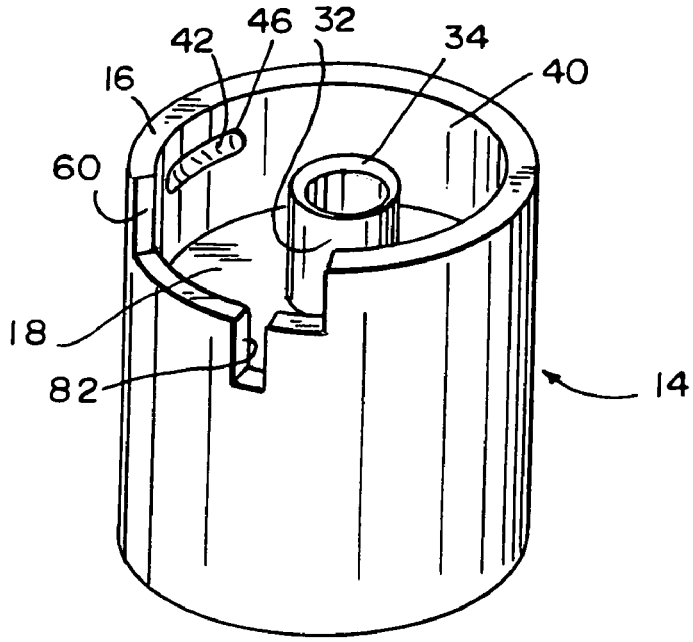
FIG. 4 is a perspective view of the locking closure of FIG. 1 without the actuator.

Referring now to the drawings, FIGS. 1–8 illustrate a dispensing package 100 in accordance with a preferred embodiment of the present invention. The dispensing package 100 includes a closure 10 (FIG. 2) having a body 14 mounted on a container 12. The container 12 defines a chamber and an orifice so that the contents of the chamber can be dispensed through the orifice. The container 12 may be of any suitable material and construction, such as a flexible resilient molded plastic. Preferably, the closure body 14 has a peripheral skirt 16 with an internal thread 40 (FIGS. 5, 6) that cooperates with an external thread (not shown) on a neck of the container 12 to secure the closure body 14 to the container 12 as shown in FIG. 1. However, as will be readily apparent to one skilled in the art, the closure 10 may be secured to the container 12 by any known mounting finish, such as a lug-style finish or a snap-on finish, to name a few.

Figure 5:
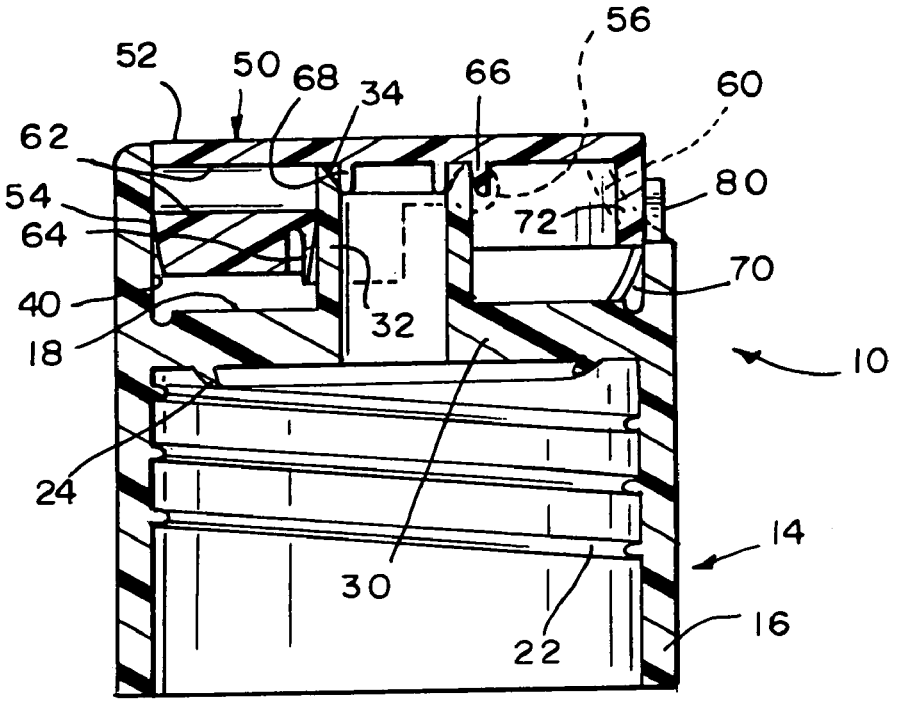
FIG. 5 is a cross-sectional view of the locking closure of FIG. 1 shown in the closed position.
Figure 6:
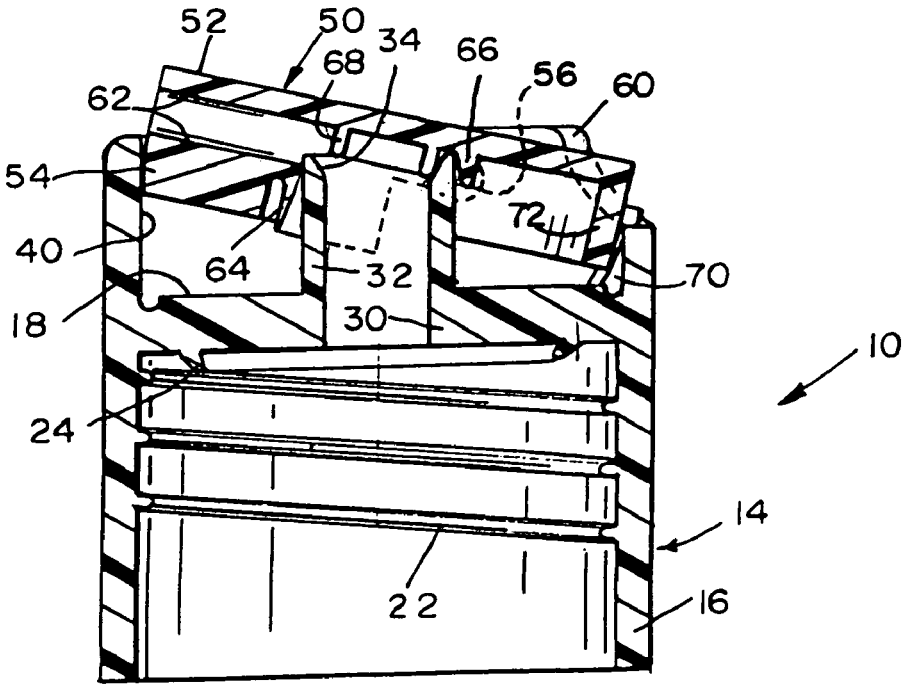
FIG. 6 is a cross-sectional view of the locking closure of FIG. 1 shown in the open position.

As shown in FIGS. 2 and 4–6, a sealing platform 18 is disposed beneath an upper edge of the closure body 14, and has an opening 30 which is in fluid communication with the orifice of the container 12 for dispensing product from within the container 12. The sealing platform 18 is designed to seat against an upper edge of the neck of the container 12 and prevent leakage of the product from the container 12 and onto the threaded finish. The sealing function of the sealing platform 18 may be accomplished through a linerless feature 24 (FIGS. 5, 6). Although FIGS. 2 and 4–6 illustrate the use of a sealing platform 18, one of skill in the art should appreciate that other seals, such as valve seals or seals formed with a sealing washer for example, may instead be used.

An actuator 50 is mounted to the closure body 14 and includes a channel 62 through which the contents of the container 12 are dispensed. The actuator 50 is defined by a top wall 52, an opposing bottom wall 54, and a side wall 55. The actuator 50 is pivotable about a pivot axis $A_P$ (FIGS. 7, 8) between an open position (FIG. 6), wherein the channel 62 and the opening 30 of the closure body 14 form a continuous fluid path with the chamber of the container 12, and a closed position (FIG. 5), wherein the channel 62 and the opening 30 of the closure body 14 do not form a continuous fluid path. In addition to being pivotable about the axis $A_P$, the actuator 50 is rotatable about an axis $A_L$ (FIGS. 7, 8) between a locked position, wherein the actuator 50 is not movable between the open and the closed position, and an unlocked position, wherein the actuator 50 is movable between the open and the closed position. The axis $A_L$ corresponds to a longitudinal axis of the dispensing package 100.

In the illustrated embodiment, the closure body 14 includes race 42, 44 (FIGS. 2, 4 and 7) which circumferentially extend along an inner portion 40 of the closure body 14. A protruding nub 46 is positioned at an end of the race 42. The actuator 50 includes opposing protrusions 56 on the side wall 55, each of which engages with and is movable within a respective race 42, 44. The protrusions 56 are preferably in a plane with the axis $A_P$ (FIGS. 7, 8). The protrusions 56 and the races 42, 44 are dimensioned such that when each protrusion 56 is positioned within the races 42, 44 the actuator 50 can pivot about the axis $A_P$, and the protrusions 56 can slide within the races 42, 44 so as to facilitate rotation of the actuator 50 about the axis $A_L$ between the locked position and the unlocked position. While the protrusions 56 and the races 42, 44 are shown on, respectively, the actuator 50 and the inner surface 40 of the closure body 14, it should be appreciated that the protrusions 56 can be positioned on the inner surface 40 of the closure body 14 and the races 42, 44 can be formed on the side wall 55 of the actuator 50.

As shown in FIGS. 2 and 4–6, the opening 30 of the closure body 14 is defined by an upwardly extending annular rim 32 which extends to a discharge opening 34. The actuator 50 includes a downwardly extending annular rim 68 which seats within an inner circumference of the upwardly extending annular rim 32 so as to form a seal between the opening 30 of the closure body 14 and the channel 62 of the actuator 50 when the actuator 50 is in the closed position as shown in FIG. 5. Additionally, the actuator 50 includes a forward seal 64 formed on the bottom wall 54 and a rear seal 66 formed on the top wall 52. The downwardly extending annular rim 68 is dimensioned such that, when the actuator 50 is in the open position, as shown in FIG. 6, the downwardly extending annular rim 68 and the upwardly extending annular rim 32 separate from each other and the opening 30 of the closure body 14 and the channel 62 of the actuator 50 form a continuous fluid pathway.

Preferably, the opening 30, the upwardly extending annular rim 32 of the closure body 14 and the downwardly extending annular rim 68 of the actuator 50 are centered relative to the closure body 14 so as to facilitate rotation of the actuator 50 about the axis $A_L$. In other words, the axis of rotation $A_L$ of the actuator 50 corresponds to the center axis of the opening 30 (FIG. 8).

To prevent the actuator 50 from being inadvertently placed in the open position, the closure body 14 is provided cut-out portion 60 having an abutting surface 33 in which a recess 82 is located, and the actuator 50 is provided with a corresponding rear profile 72, including a tab 80 which extends outward from the actuator 50 (FIGS. 2–4 and 7). The tab 80 and the recess 82 cooperate with each other such that when the tab 80 and the recess 82 are aligned, the actuator 50 is pivotable about the axis $A_P$ between the closed position (FIG. 5) and the open position (FIG. 6). When the tab 80 and the recess 82 are not aligned, the actuator 50 is not pivotable about the axis $A_P$ between the closed position and the open position because a bottom surface of the tab 80 rests against the abutting surface 33 of the cut-out portion 60 of the closure body 14. Preferably, the abutting surface 33 is dimensioned to accept the finger of a user of the dispensing package 100.

When the actuator 50 is in the closed position, the bottom surface of the tab 80 resting against the abutting surface 33 of the closure body 14 prevents the accidental pivoting of the actuator 50 into the open position during shipment and handling of the dispensing package 100 prior to delivery to the consumer. When the consumer is ready to initially open the dispensing package 100, the consumer first rotates the actuator 50 into the unlocked position such that the tab 80 is aligned with the recess 82. Then, the consumer places the actuator 50 in the open position by pressing downwardly on the edge of the actuator 50 overlying the cut-out portion 33. Since the tab 80 is designed to fit within recess 82 when the actuator 50 is placed in the open position, the tab 80 and/or recess 82 are not destroyed or deformed during the initial or subsequent openings by the consumer. Because of this, after the consumer initially opens the dispensing package 100, the closure body 14 can be returned to the locked position by reversing the above steps and placing the actuator 50 in the locked position. The protruding nub 46 located in the race 42 provides user feedback to indicate that the actuator 50 has been successfully locked. In the above-described manner, the closure 10 can be used by the consumer to prevent further unwanted opening of the dispensing package 100 after the initial shipment to the consumer, such as when the dispensing package 100 is packed for travel by the consumer.

The protruding nub 46, in addition to providing user feedback to indicate that the actuator 50 has been successfully locked, also provides resistance in the unlocking of the actuator 50. Additionally, a resistance wedge 70 is positioned on the inner surface 40 of the closure body 14 near the sealing platform to provide resistance to the movement of the actuator 50 into either the open or the closed positions.

The location of the protrusions 56 along the pivot axis $A_P$, which is in a plane parallel to but offset from the plane $P_L$ (FIGS. 7, 8) in which the longitudinal axis $A_L$ exists, allows the actuator 50 to pivot so as to provide sufficient clearance for the channel 62 from the peripheral skirt 16 of the closure body 14 to allow proper flow from the channel 62. As illustrated in FIGS. 7, 8, the protrusions 56 are in the plane of the pivot axis $A_P$, which is parallel to the plane $P_L$ and between the plane $P_L$ and the tab 80.

As seen in FIG. 9 race 44 is on the actuator 50 and the protrusion 56 are on the body 14.

While the invention has been described in detail in connection with exemplary embodiments known at the time, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Accordingly, the invention is not to be seen as limited by the foregoing description, but is only limited by the scope of the appended claims.

What is claimed as new and desired to be protected by Letters Patent of the United States is:

1. A closure comprising:

a body having an opening; and an actuator mounted to the body about a longitudinal axis of the body, said actuator having a channel, a rear profile and being pivotable between an open position and a closed position and wherein the actuator is rotatable between a locked position in which the actuator is locked against movement between the open and the closed position and an unlocked position in which the actuator is movable between the open and the closed position;

wherein the actuator is pivotable about a pivot axis located between the longitudinal axis and said rear profile.

2. The closure according to claim 1, wherein in the open position the channel and the opening of the body form a continuous fluid path and in the closed position the channel and the opening of the body do not form a continuous fluid path.

3. The closure according to claim 1, wherein the body further includes a recess, the rear profile of said actuator includes a tab extending outward from the actuator for cooperation with the recess of the body such that when the tab and the recess are aligned the actuator is pivotable between the closed position and the open position, and when the tab and the recess are not aligned the actuator is hindered from pivoting between the closed position and the open position.

4. The closure according to claim 3, wherein the body includes a cut-out portion, the recess being located in the cut-out portion.

5. A closure comprising:

a body having an opening;

an actuator mounted to the body about a longitudinal axis of the body, said actuator having a channel, a rear profile and being pivotable between an open position and a closed position and wherein the actuator is rotatable between a locked position and an unlocked position;

wherein the actuator is pivotable about a pivot axis located between the longitudinal axis and said rear profile; and wherein the opening is centered relative to the longitudinal axis of the body and an axis of rotation of the actuator corresponds to a center axis of the opening.

6. A closure comprising:

a body having an opening;

an actuator mounted to the body about a longitudinal axis of the body, said actuator having a channel, a rear profile and being pivotable between an open position and a closed position and wherein the actuator is rotatable between a locked position and an unlocked position;

wherein the actuator is pivotable about a pivot axis located between the longitudinal axis and said rear profile; and wherein the body further includes a pair of races extending circumferentially along an interior portion of the body, and the actuator further includes a pair of protrusions each being engagable with a respective race and movable along the races so as to facilitate rotation of the actuator between the locked position and the unlocked position.

7. The closure according to claim 6, wherein said actuator is pivotable about said protrusions.

8. The closure according to claim 7, wherein said protrusions are in a plane with the pivot axis.

9. A dispensing package comprising:

a container defining a chamber and having an orifice in fluid communication with the chamber; and a closure mounted on the container, the closure comprising:

a body having an opening, the opening located to be in fluid communication with the orifice of the container; and an actuator mounted to the body about a longitudinal axis of the body, said actuator having a channel, a rear profile and being pivotable between an open position and a closed position and wherein the actuator is rotatable between a locked position in which the actuator is locked against movement between the open and the closed position and an unlocked position in which the actuator is movable between the open and the closed position;

wherein the actuator is pivotable about a pivot axis located between the longitudinal axis and said rear profile.

10. The dispensing package according to claim 9, wherein in the open position the channel and the opening of the body form a continuous fluid path with the chamber of the container and in the closed position the channel and the opening of the body do not form a continuous fluid path.

11. The dispensing package according to claim 9, wherein the body further includes a recess, the rear profile of said actuator includes a tab extending outward from the actuator for cooperation with the recess of the body such that when the tab and the recess are aligned the actuator is pivotable between the closed position and the open position, and when the tab and the recess are not aligned the actuator is hindered from pivoting between the closed position and the open position.

12. The dispensing package according to claim 11, wherein the body includes a cut-out portion and the recess is located in the cut-out portion.

13. A dispensing package comprising:

a container defining a chamber and having an orifice in fluid communication with the chamber; and a closure mounted on the container, the closure comprising:

a body having an opening, the opening located to be in fluid communication with the orifice of the container; and an actuator mounted to the body about a longitudinal axis of the body, said actuator having a channel, a rear profile and being pivotable between an open position and a closed position and wherein the actuator is rotatable between a locked position and an unlocked position;

wherein the actuator is pivotable about a pivot axis located between the longitudinal axis and said rear profile and wherein the opening is centered relative to the longitudinal axis of the body and an axis of rotation of the actuator corresponds to a center axis of the opening.

14. A dispensing package comprising:

a container defining a chamber and having an orifice in fluid communication with the chamber; and a closure mounted on the container, the closure comprising:

a body having an opening, the opening located to be in fluid communication with the orifice of the container; and an actuator mounted to the body about a longitudinal axis of the body, said actuator having a channel, a rear profile and being pivotable between an open position and a closed position and wherein the actuator is rotatable between a locked position and an unlocked position;

wherein the actuator is pivotable about a pivot axis located between the longitudinal axis and said rear profile and wherein the body further includes a pair of races extending circumferentially along an interior portion of the body, and the actuator further includes a pair of protrusions each being engagable with a respective race and movable along the races so as to facilitate rotation of the actuator between the locked position and the unlocked position.

15. The dispensing package according to claim 14, wherein said actuator is pivotable about said protrusions.

16. The dispensing package according to claim 15, wherein said protrusions are in a plane with the pivot axis.

17. A closure comprising:

a body having an opening; and an actuator mounted to the body about a longitudinal axis of the body, said actuator having a channel, a rear profile and being pivotable between an open position and a closed position and wherein the actuator is rotatable between a locked position and an unlocked position;

wherein the actuator is pivotable about a pivot axis located between the longitudinal axis and said rear profile, and wherein the opening is centered relative to the longitudinal axis of the body and an axis of rotation of the actuator corresponds to a center axis of the opening.

18. A closure comprising:

a body having an opening and a pair of races extending circumferentially along an interior portion of the body; and an actuator mounted to the body about a longitudinal axis of the body, said actuator having a channel, a rear profile, a pair of protrusions each being engagable with a respective race and movable along the races, said actuator being pivotable between an open position and a closed position and wherein the actuator is rotatable between a locked position and an unlocked position;

wherein the actuator is pivotable about a pivot axis located between the longitudinal axis and said rear profile.

19. A dispensing package comprising:

a container defining a chamber and having an orifice in fluid communication with the chamber; and a closure mounted on the container, the closure comprising:

a body having an opening, the opening located to be in fluid communication with the orifice of the container; and an actuator mounted to the body about a longitudinal axis of the body, said actuator having a channel, a rear profile and being pivotable between an open position and a closed position and wherein the actuator is rotatable between a locked position and an unlocked position;

wherein the actuator is pivotable about a pivot axis located between the longitudinal axis and said rear profile, and wherein the opening is centered relative to the longitudinal axis of the body and an axis of rotation of the actuator corresponds to a center axis of the opening.

20. A dispensing package comprising:

a container defining a chamber and having an orifice in fluid communication with the chamber; and a closure mounted on a container, the closure comprising:

a body having an opening and a pair of races extending circumferentially along an interior portion of the body, the opening located to be in fluid communication with the orifice of the container; and an actuator mounted to the body about a longitudinal axis of the body, said actuator having a channel, a rear profile, a pair of protrusions each being engagable with a respective race and movable along the races, said actuator being pivotable between an open position and a closed position and wherein the actuator is rotatable between a locked position and an unlocked position;

wherein the actuator is pivotable about a pivot axis located between the longitudinal axis and said rear profile.

21. A method for discharging contents from a container, the method comprising:

providing a container closure having a body with an opening and an actuator mounted to the body about a longitudinal axis of the body, the actuator having a channel a rear profile and being pivotable between an open position and a closed position and rotatable between a locked position in which the actuator is locked against movement between the open and the closed position and an unlocked position in which the actuator is movable between the open and closed position;

rotating the actuator into the unlocked position; and pivoting the actuator into the open position such that the contents of the container can be discharged, wherein the actuator is pivotable about a pivot axis located between the longitudinal axis and the rear profile.

22. The method for discharging contents from a container according to claim 21, wherein the open position the contents of the container are capable of being discharged and in the closed position the contents of the container are not capable of being discharged.

23. The method for discharging contents from a container according to claim 21, further comprising pivoting the actuator into the closed position after the discharge of the contents from the container.

24. The method for discharging the contents from a container according to claim 23, further comprising rotating the actuator into the locked position so as to prevent the pivoting of the actuator into the open position.

25. A closure comprising:

a body having an opening; and an actuator mounted to the body about a longitudinal axis of the body, said actuator having a channel, a rear profile and being pivotable between an open position and a closed position and wherein the actuator is rotatable between a locked position and an unlocked position, said actuator being pivotable about a pivot axis located between the longitudinal axis and said rear profile, wherein one of the body and the actuator includes a race extending circumferentially along or portion, and the other of the body and the actuator includes at least one protrusion engageable with the race and movable along the race so as to facilitate rotation of the actuator between the locked position and the unlocked position.

26. The closure of claim 25 wherein the body includes the race extending circumferentially along an interior portion of the body and the actuator includes the at least one protrusion.

27. A closure comprising:

a body having an opening; and an actuator mounted to the body about a longitudinal axis of the body, said actuator having a channel, a rear profile and being pivotable between an open position and a closed position and wherein the actuator is rotatable between a locked position and an unlocked position, said actuator being pivotable about a pivot axis located between the longitudinal axis and said rear profile, wherein one of the actuator and the body includes a recess, the other of the actuator and the body including a tab extending inward for cooperation with the recess such that when the tab and the recess are aligned with the actuator is pivotable between the closed position and the open position, and when the tab and the recess are not aligned the actuator is hindered from pivoting between the closed position and the open position.

28. The closure of claim 27 wherein the body includes the recess, and the actuator includes the tab extending outward from the actuator for cooperation with the recess of the body.

29. A dispensing package comprising:

a container defining a chamber and having an orifice in fluid communication with the chamber; and a closure mounted on the container, the closure comprising:

a body having an opening, the opening located to be in fluid communication with the orifice of the container;

wherein the opening is centered relative to the body and an axis of rotation of the actuator corresponds to a center axis of the opening; and an actuator mounted to the body about a longitudinal axis of the body, said actuator having a channel, a rear profile and being pivotable between an open position and a closed position and wherein the actuator is rotatable between a locked position and an unlocked position, said actuator being pivotable about a pivot axis located between the longitudinal axis and said rear profile.

30. A dispensing package comprising:

a container defining a chamber and having an orifice in fluid communication with the chamber; and a closure mounted on the container, the closure comprising:

a body having an opening, the opening located to be in fluid communication with the orifice of the container; and an actuator mounted to the body about a longitudinal axis of the body, said actuator having a channel, a rear profile and being pivotable between an open position and a closed position and wherein the actuator is rotatable between a locked position and an unlocked position, said actuator being pivotable about a pivot axis located between the longitudinal axis and said rear profile;

wherein one of the and the actuator body further includes a race extending circumferentially along an interior portion of the body, and the other of the body and the actuator further includes at least one protrusion engageable with the race and movable along the race so as to facilitate rotation of the actuator between the locked position and the unlocked position.

31. The dispensing package of claim 30 wherein the actuator includes the race extending circumferentially along an exterior portion of the body, and the body further includes at least one protrusion engageable with the race and movable along the race so as to facilitate rotation of the actuator between the locked position and the unlocked position.

32. The dispensing package of claim 30 wherein the actuator further includes a recess and the body further includes a tab extending inward from the body for cooperation with the recess of the actuator such that when the tab and the recess are aligned the actuator is pivotable between the closed position and the open position, and when the tab and the recess are not aligned the actuator is not pivotable between the closed position and the open position.

* * * * *